US006216647B1

(12) United States Patent
Bailey

(10) Patent No.: US 6,216,647 B1
(45) Date of Patent: Apr. 17, 2001

(54) FREE PISTON INTERNAL COMBUSTION ENGINE WITH PISTON HEAD HAVING NON-METALLIC BEARING SURFACE

(75) Inventor: Brett M. Bailey, Peoria, IL (US)

(73) Assignee: Caterpillar Inc., Peoria, IL (US)

( * ) Notice: Subject to any disclaimer, the term of this patent is extended or adjusted under 35 U.S.C. 154(b) by 0 days.

(21) Appl. No.: 09/255,303

(22) Filed: Feb. 22, 1999

(51) Int. Cl.[7] ..... F02B 71/00
(52) U.S. Cl. ..... 123/46 R; 123/46 SC
(58) Field of Search ..... 123/46 R, 46 SC, 123/193.6, 669

(56) References Cited

U.S. PATENT DOCUMENTS

| | | | | |
|---|---|---|---|---|
| 4,020,804 | * | 5/1977 | Bailey | 123/46 R |
| 4,589,380 | * | 5/1986 | Coad | 123/46 R |
| 4,724,800 | * | 2/1988 | Wood | 123/59.7 |
| 4,736,676 | * | 4/1988 | Taylor | 123/193.6 |
| 4,867,119 | * | 9/1989 | Cooper et al. | 123/193.6 |
| 4,986,234 | * | 1/1991 | Bell | 123/193.4 |
| 5,437,821 | * | 8/1995 | Diberardino et al. | 264/29.1 |
| 5,483,869 | * | 1/1996 | Bock et al. | 123/193.6 |
| 5,540,194 | * | 7/1996 | Adams | 123/46 R |
| 5,724,933 | * | 3/1998 | Silvonen et al. | 123/193.6 |
| 5,740,788 | * | 4/1998 | Atmur et al. | 123/193.6 |
| 5,816,211 | * | 10/1998 | Atmur et al. | 123/193.6 |
| 5,975,040 | * | 11/1999 | Silvonen et al. | 123/193.6 |

FOREIGN PATENT DOCUMENTS

| | | |
|---|---|---|
| 38 20 240 A1 | 1/1989 | (DE) . |
| 195 45 397 A1 | 6/1997 | (DE) . |
| 0 108 475 A1 | 11/1980 | (EP) . |
| 2 602 273 | 5/1988 | (FR) . |

OTHER PUBLICATIONS

TU Dresden—publication date unknown—earliest date 1993—Dresden University in Germany.

* cited by examiner

*Primary Examiner*—Tony M. Argenbright
*Assistant Examiner*—Jason Benton
(74) *Attorney, Agent, or Firm*—Todd T. Taylor

(57) ABSTRACT

A free piston internal combustion engine includes a combustion cylinder having an inside surface. A piston is reciprocally disposed within the combustion cylinder. The piston includes a piston head and a plunger rod attached to the piston head. The piston head has an outside surface lying closely adjacent to and defining a bearing surface with the inside surface of the combustion cylinder. The bearing surface consists essentially of a non-metallic material.

21 Claims, 5 Drawing Sheets

FREE PISTON INTERNAL COMBUSTION ENGINE WITH PISTON HEAD HAVING NON-METALLIC BEARING SURFACE

TECHNICAL FIELD

The present invention relates to free piston internal combustion engines, and, more particularly, to piston and cylinder configurations within such engines.

BACKGROUND ART

Free piston internal combustion engines include one or more pistons which are reciprocally disposed within corresponding combustion cylinders. Each piston is typically rigidly attached to a plunger rod which provides a desired work output. For example, the plunger rod may be used to provide electrical power output by inducing an electrical current, or fluid power output such as pneumatic or hydraulic power output.

Pistons used in free piston internal combustion engines typically include a piston head which is entirely constructed from a metallic material such as aluminum or steel. Metals such as aluminum and steel have a relatively high coefficient of thermal expansion. Thus, during operation of the free piston engine, the metallic piston head expands considerably in the radial direction toward the inside surface of the combustion cylinder. Each piston head used in the free piston engine is thus formed with an outside diameter which provides a considerable radial clearance with the inside surface of the combustion cylinder to accommodate the relatively large radial expansion during operation. To prevent blow-by of combustion products past the piston head during operation, the outside peripheral surface of the piston head is formed with one or more piston ring grooves which receive corresponding piston rings therein. The piston rings allow for radial thermal expansion and contraction of the piston head, while at the same time effectively preventing blow-by of combustion products past the piston head.

Although piston rings provide valuable functionality as indicated above, it would be desirable to eliminate the use of piston rings to reduce manufacturing and assembly costs.

Moreover, to prevent excessive wear between the piston rings and the inside surface of the combustion cylinder, it is necessary to lubricate the piston rings with a suitable lubricant. The lubrication system for lubricating the piston rings may require additional porting and/or other structure to effect proper lubrication, which in turn increases the size and complexity of the engine. Additionally, the lubricating oil may increase undesirable emissions from the engine.

Another problem with using conventional piston and cylinder arrangements including a metallic combustion cylinder and metallic piston head with piston rings is that suitable fluid cooling channels must be provided within the combustion cylinder to effect the proper cooling of the combustion cylinder and piston head. These cooling fluid channels again increase the size and complexity of the engine.

The present invention is directed to overcoming one or more of the problems as set forth above.

SUMMARY OF THE INVENTION

The present invention provides a free piston internal combustion engine with a piston head having a non-metallic radially outside bearing surface with low friction, low thermal expansion and high temperature resistance properties.

In one aspect of the invention, a free piston internal combustion engine includes a combustion cylinder having an inside surface. A piston is reciprocally disposed within the combustion cylinder. The piston includes a piston head and a plunger rod attached to the piston head. The piston head has a cylindrical outside surface lying closely adjacent to and defining a bearing surface with the inside surface of the combustion cylinder. The bearing surface consists essentially of a non-metallic material.

An advantage of the present invention is that the need for lubricating oil and cooling fluid in the free piston engine is eliminated, thereby eliminating the increased physical size and decreased efficiency losses associated with such structure.

Another advantage is that the radial clearance between the piston head and cylinder inside surface is substantially reduced or eliminated, thereby eliminating the need for piston ring grooves and piston rings in the piston head.

Yet another advantage is that the portion of the piston head defining the bearing surface is constructed from a material having low friction, low thermal expansion and high temperature resistance properties.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
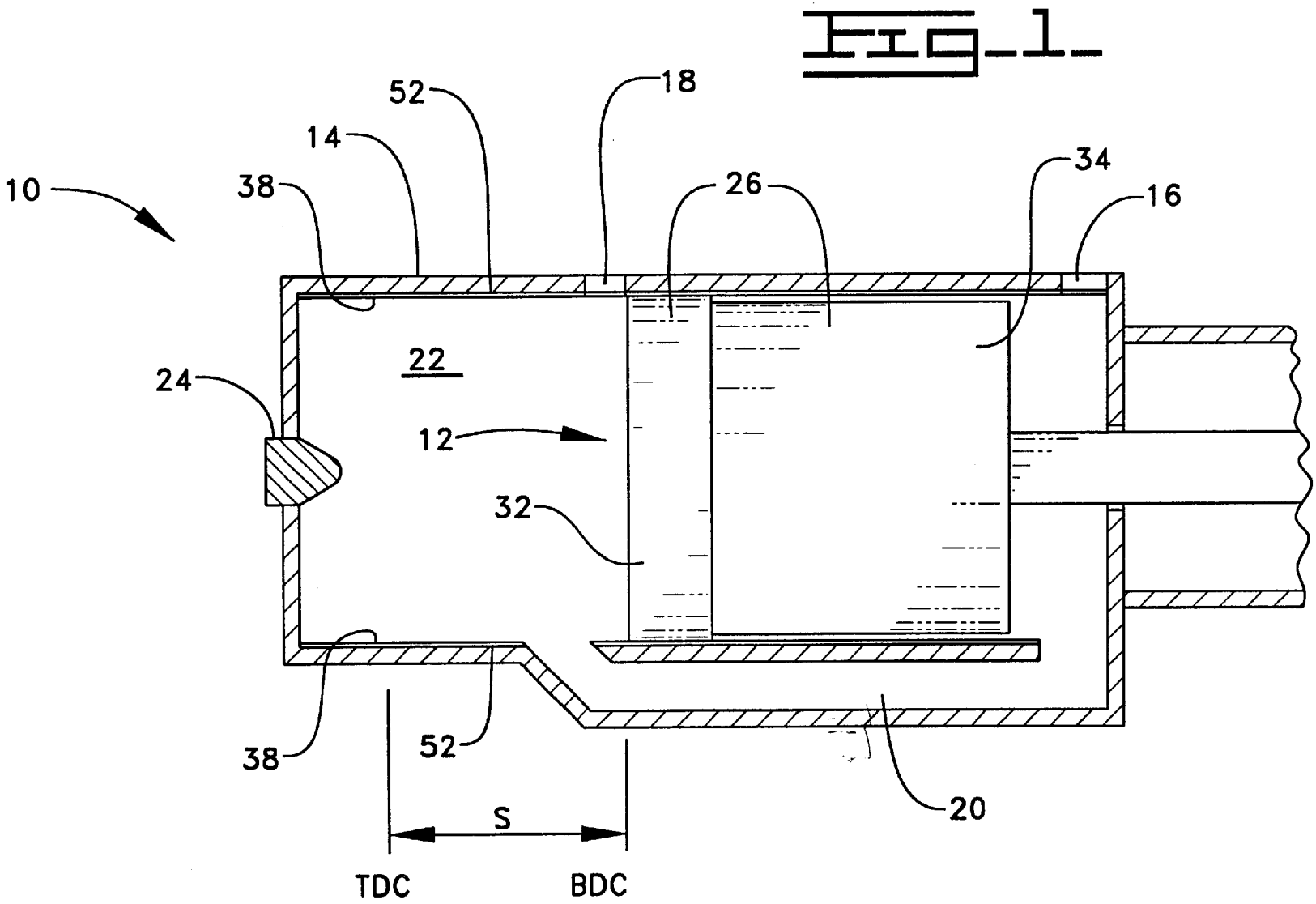
FIG. 1 is a simplified side, sectional view of a portion of a free piston internal combustion engine with an embodiment of a piston of the present invention disposed therein.
Figure 2:
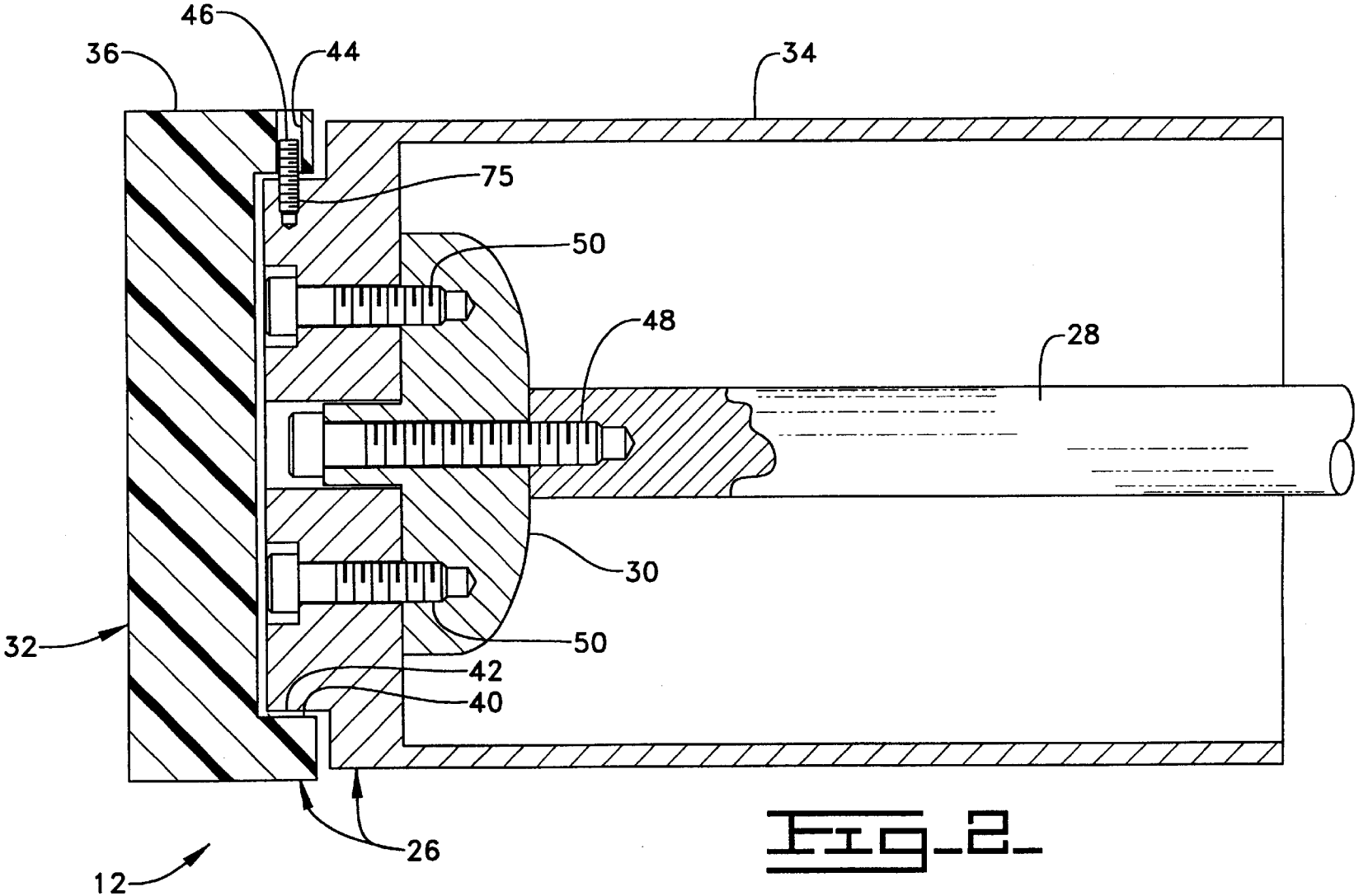
FIG. 2 is a side, sectional view of the piston shown in FIG. 1.

Referring now to the drawings, and more particularly to FIG. 1, there is shown a simplified side, sectional view of an embodiment of a portion of a free piston internal combustion engine 10 including an embodiment of a piston 12 of the present invention, shown in more detail in FIG. 2.

Free piston engine 10 includes a combustion cylinder 14 with a combustion air inlet 16 and an exhaust outlet 18. In this embodiment, combustion cylinder 14 has a substantially circular cross section. Combustion air is transported through combustion air inlet 16 and an air scavenging channel into combustion chamber 22 when piston 12 is at or near a bottom dead center (BDC) position. An appropriate fuel, such as a selected grade of diesel fuel, is injected into combustion chamber 22 as piston 12 moves toward a top dead center (TDC) position using a controllable fuel injector system, schematically shown and referenced as 24. The stroke length (S) of piston 12 between the BDC position and TDC position may be fixed or variable.

Referring now to FIG. 2, piston 12 is shown in greater detail. Piston 12 is reciprocally disposed within combustion cylinder 14 and generally includes a piston head 26 which is attached to a plunger rod 28 using a mounting flange 30.

Piston head 26 includes a non-metallic cap 32 which is connected to a metallic skirt 34. Cap 32 has a cylindrical outside surface 36 with a diameter which is larger than the outside diameter of skirt 34. Outside surface 36 lies closely adjacent to and defines a bearing surface with an inside surface 38 (FIG. 1) of combustion cylinder 14. In the embodiment shown, outside surface 36 of cap 32 and inside surface 38 of combustion cylinder 14 have a radial operating clearance therebetween of between approximately 0.000 and 0.002 inch, preferably between approximately 0.000 and 0.001 inch, and more preferably approximately 0.000 inch. The term "radial operating clearance", as used herein, means the radial clearance between outside surface 36 of cap 32 and inside surface 38 of combustion cylinder 14 when free piston engine 10 is under operating conditions. That is, the radial operating clearance is designed to be within the range as set forth herein when piston 12 and combustion cylinder 14 are at an operating temperature.

As shown in FIG. 2, outside surface 36 of cap 32 does not include any piston ring grooves therein, and accordingly does not carry any piston rings. To prevent excessive blow-by of exhaust products during the return stroke of piston 12, and to prevent excessive wear between outside surface 36 of cap 32 and inside surface 38 of combustion cylinder 14, cap 32 is formed from a material having selected physical properties. More particularly, cap 32 is formed from a non-metallic material having a relatively low coefficient of thermal expansion, low coefficient of friction and high temperature resistance. Examples of such non-metallic materials which have been found to be suitable include composite materials and ceramic materials. In the embodiment shown, cap 32 is formed from a carbon-carbon composite material having carbon reinforcing fibers within a carbon matrix. The carbon matrix may include carbon powder within a suitable resin. The carbon reinforcing fibers may be randomly oriented chopped fibers or may be longer filaments which are either randomly oriented or oriented in one or more directions.

The non-metallic material from which cap 32 is constructed preferably has a coefficient of thermal expansion of between approximately 0.5 and 10 ppm/° C. In the embodiment shown, the carbon-carbon composite material from which cap 32 is constructed has a coefficient of thermal expansion of between approximately 1 and 2 ppm/° C. Moreover, the non-metallic material from which cap 32 is constructed preferably has a coefficient of friction of between 0.01 and 0.15. In the embodiment shown, the carbon—carbon composite material from which cap 32 is constructed has a coefficient of friction of approximately 0.10. Additionally, the non-metallic material from which cap 32 is constructed preferably has a temperature resistance up to an average temperature of between approximately 400° C. and 2500° C. In the embodiment shown, the carbon-carbon composite material from which cap 32 is constructed has a temperature resistance up to an average temperature of approximately 500° C. The temperature resistance may be increased by applying a coating on the face of cap 32 adjacent combustion chamber 22.

Skirt 34 is formed from a suitable metallic material, such as aluminum or steel. In the embodiment shown, skirt 34 is formed from aluminum. Since the coefficient of thermal expansion of metallic skirt 34 is larger than the coefficient of thermal expansion of cap 32, the outside diameter of skirt 34 when at a non-operating temperature is small enough so that the outside diameter of skirt 34 does not exceed the outside diameter of outside surface 36 when at an operating temperature. That is, skirt 34 is not intended to be a primary bearing surface with inside surface 38 of combustion cylinder 14. of course, some intermittent contact may occur between the outside diameter of skirt 34 and inside surface of 38; however, skirt 34 is not intended to be a primary bearing surface.

Cap 32 and skirt 34 are connected together such that cap 32 may move a limited extent in a radial direction relative to skirt 34. More particularly, cap 32 includes a stepped inner surface 40 with a diameter which is larger than an outside diameter of a shoulder 42 of skirt 34. In the embodiment shown, a radial clearance of between approximately 0.001 and 0.003 inch, and more preferably approximately 0.002 inch is formed between inner surface 40 and shoulder 42. A plurality of radially extending holes 44 (four holes in the embodiment shown) receive respective set screws 46 therein which are threadingly engaged with shoulder 42. The inside diameter of each hole 44 is larger than the outside diameter of a corresponding set screws 46 so that set screws 46 retain cap 32 to skirt 34 while at the same allowing relative movement therebetween. Plunger rod 32 may be carried by a pair is of bearings along the axial length thereof which do not perfectly align with the longitudinal axis of combustion cylinder 14 because of manufacturing tolerances, etc. By allowing cap 32 to move in a radial direction relative to skirt 34, lateral loads on plunger rod 28 during reciprocation within free piston engine 10 are reduced or eliminated.

Combustion cylinder 14, in the embodiment shown, includes a liner 52 which defines inside surface 38. Liner 52 is formed from a non-metallic material having physical properties which are similar to the non-metallic material from which cap 32 is formed, as described above. In the embodiment shown, liner 52 is also formed from a carbon-carbon composite material with physical properties which are substantially the same as the carbon-carbon composite material from which cap 32 is formed. Since the carbon—carbon composite material from which each of outside surface 36 and inside surface 38 are formed has a relatively low coefficient of friction, wear between outside surface 36 and inside surface 38 is minimized. Moreover, since the carbon-carbon composite material from which each of outside surface 36 and inside surface 38 are formed has a relatively low coefficient of thermal expansion, the radial operating clearance therebetween can be maintained at a minimum distance (e.g., 0.000 inch), thereby preventing blow-by of combustion products during operation.

To assemble piston 12, bolt 48 is passed through mounting flange 30 and screwed into an end of plunger rod 28. Mounting flange 30 is then placed within metal skirt 34 and a plurality of bolts 50 are used to attach skirt 34 with mounting flange 30. Cap 32 is then placed over the end of skirt 34 and the plurality of set screws 46 are passed through the corresponding holes 44 in cap 32 and screwed into shoulder 42 of skirt 34. Piston 12 may then be installed within free piston engine 10.

Figure 3:
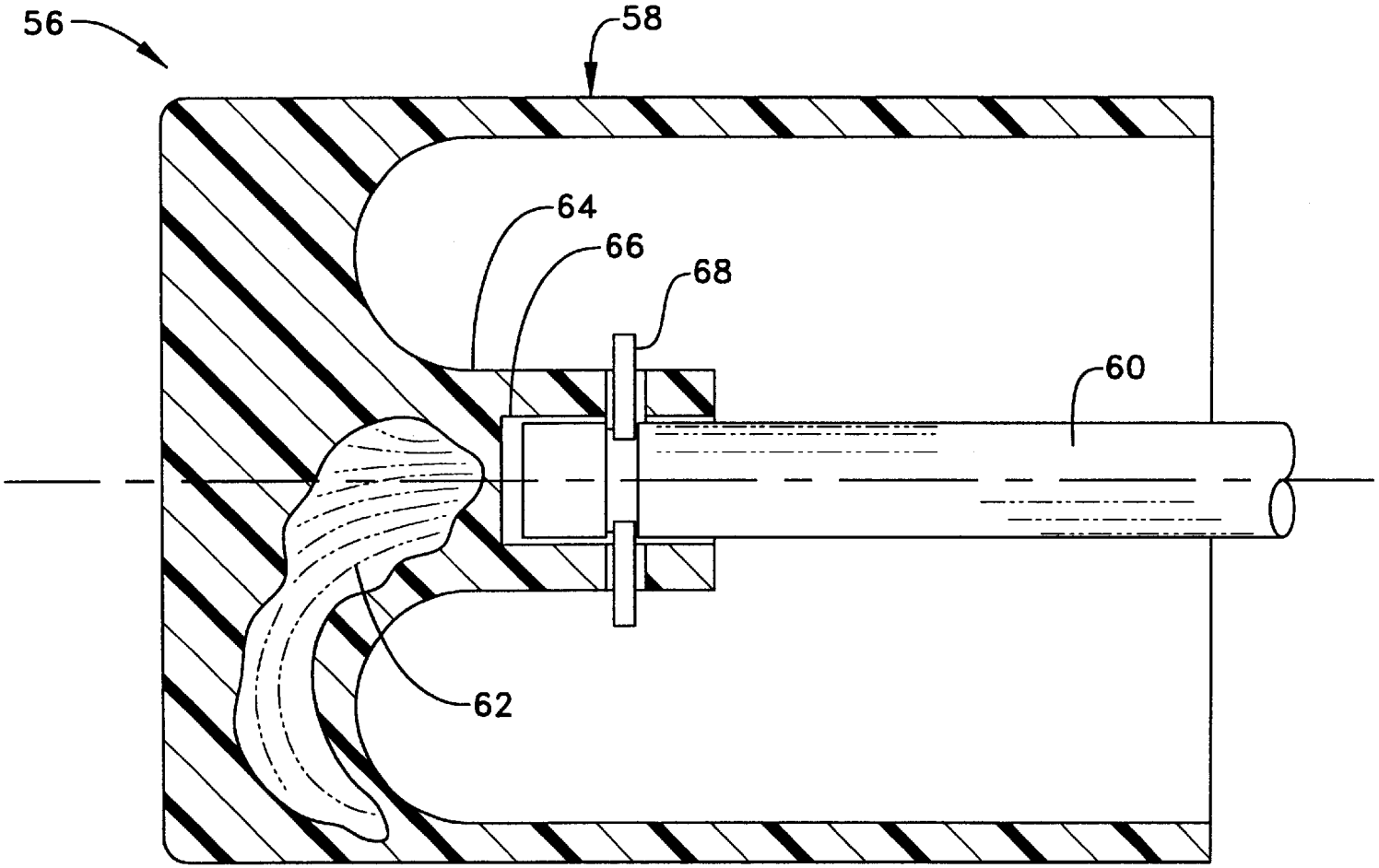
FIG. 3 is a side, sectional view of another embodiment of a piston of the present invention.

Referring now to FIG. 3, there is shown a side, sectional view of another embodiment of a piston 56 of the present invention, including a piston head 58 and plunger rod 60.

Piston head 58 is formed entirely from a carbon—carbon composite material having carbon reinforcing fibers 62 which are oriented within piston head 58 generally as shown to provide strength to piston head 58 upon axial loading in either direction by plunger rod 60. Piston head 58 includes a hub 64 with an opening 66 having an inside diameter which is larger than an outside diameter of plunger rod 60 to thereby provide a desired radial operating clearance therebetween. A snap ring 68 attaches hub 64 to plunger rod 60, while at the same time allowing relative radial movement therebetween.

Figure 5:
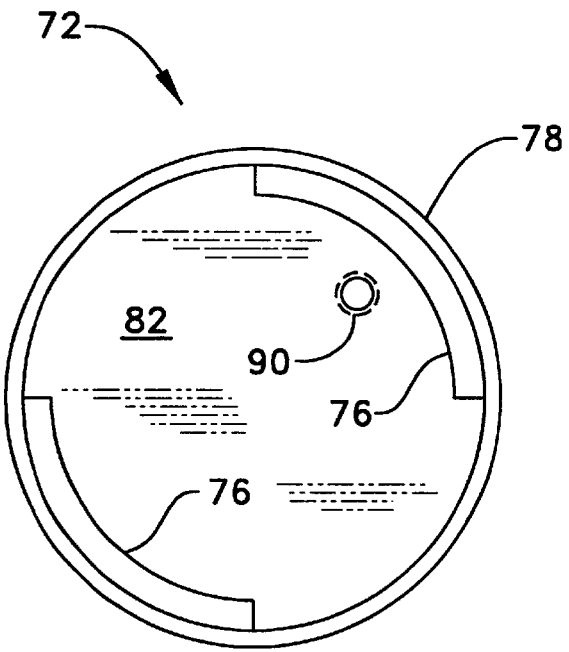
FIG. 5 is a rear view of the piston head of FIG. 4.
Figure 4:
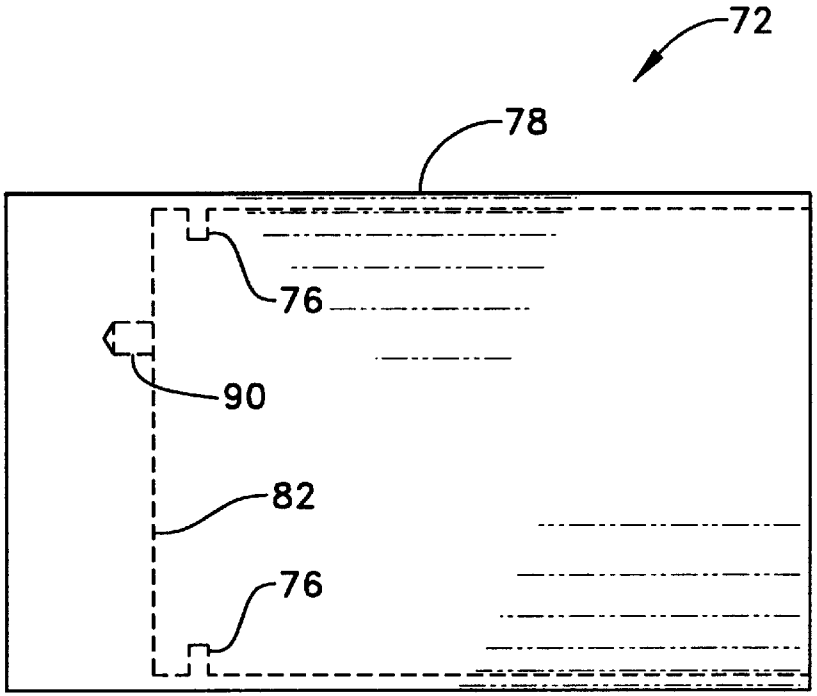
FIG. 4 is a side, sectional view of yet another embodiment of a piston head of the present invention.
Figure 6:
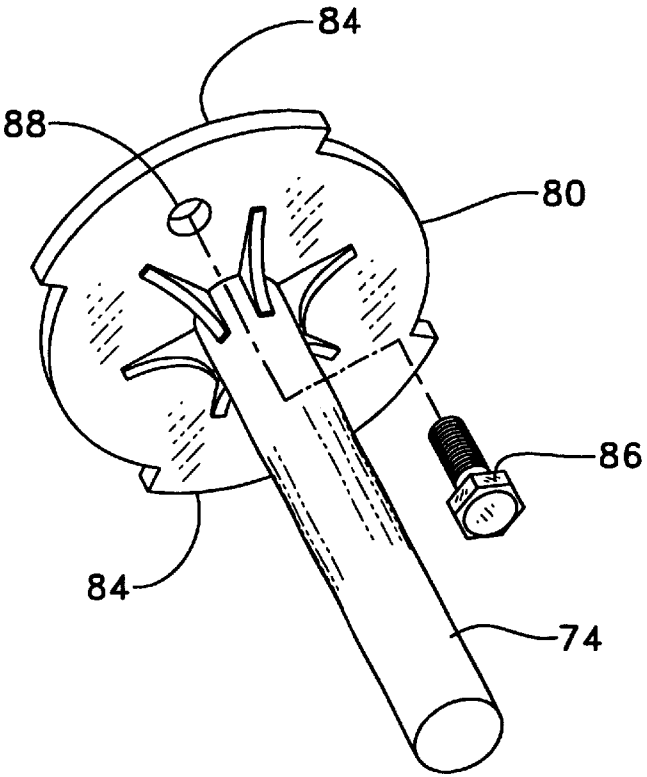
FIG. 6 is a perspective view of an embodiment of a plunger which may be used with the piston head of FIGS. 4 and 5.

Referring now to FIGS. 4–6, there is shown yet another embodiment of a piston including a piston head 72 (FIGS. 4 and 5) which is attached with a plunger rod 74 (FIG. 6). Piston head 72, in the embodiment shown, is constructed entirely from a carbon—carbon composite material. A pair of locking flanges 76 project radially inwardly from opposite sides of skirt 78. A hub 80 attached to plunger rod 74 is placed against a rear face 82 of piston head 72. Plunger rod 74 is rotated so that ears 84 projecting radially outwardly from hub 82 are disposed between locking flanges 76 and rear face 82. A set screw or bolt 86 passes through a hole 88 in hub 80 and is threadingly engaged with a hole 90 in rear face 82 of piston head 72. The radial clearance between the inside diameter of hole 88 and the shaft of bolt 86, as well as the radial operating clearance between ears 84 and the inside diameter of skirt 78, allow relative radial movement between plunger rod 74 and piston head 72 during operation.

Figure 7:
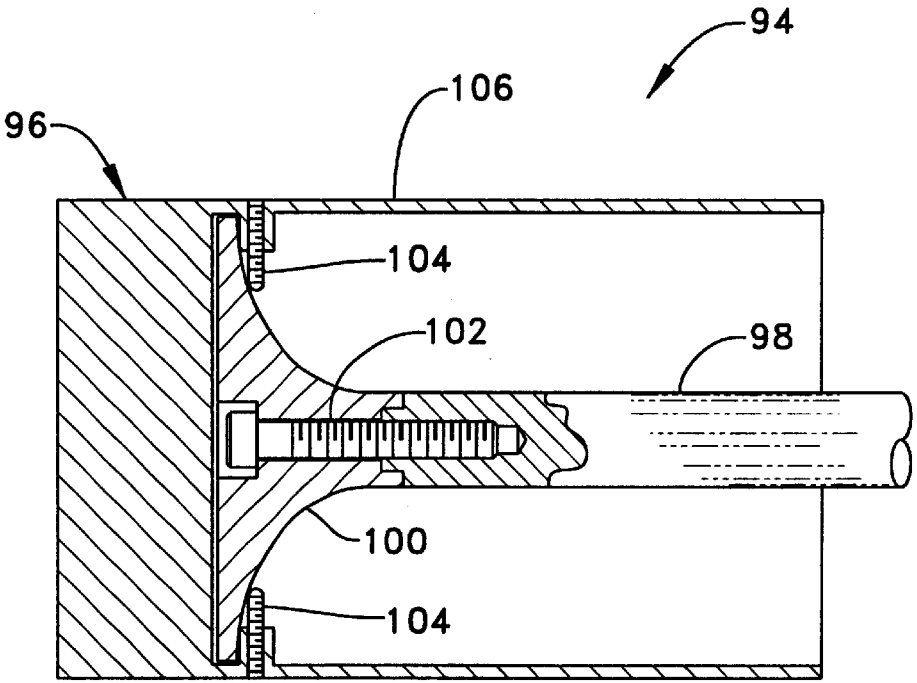
FIG. 7 is a side, sectional view of still another embodiment of a piston of the present invention.

Referring now to FIG. 7, there is shown a side, sectional view of still another embodiment of a piston 94 of the present invention, including a piston head 96 and a plunger rod 98. Piston head 96 is formed from a carbon—carbon composite material with physical properties as described above. Metallic plunger rod 98 is attached to a metallic mounting hub 100 using a bolt 102. A plurality of bolts or pins 104 which extend radially through skirt 106 of piston head 98 interconnect piston head 96 with plunger rod 98 while at the same time allowing relative movement therebetween within a desired range, dependent upon the specific application.

In the embodiments shown in the drawings and described above, piston heads 26, 58, 72 and 96 each include a generally flat face on the side facing combustion chamber 22. However, it is to be appreciated that the shape of the face disposed adjacent to combustion chamber 22 may vary, dependent upon the specific application.

Moreover, in the embodiments shown in the drawings, piston heads 26, 58, 72 and 96 have a cylindrical cross-sectional shape. However, piston heads 26, 58, 72 and 96 and combustion cylinder 14 may have any desired cross-sectional shape such as oval, rectangular, square, star, etc.

INDUSTRIAL APPLICABILITY

During use, the selected piston 12, 56, 72 and 74, or 94 is reciprocally disposed within combustion cylinder 14. The selected piston travels between a BDC position and a TDC position during a compression stroke, and between a TDC position and BDC position during a return stroke. Combustion air is introduced into combustion chamber 22 through combustion inlet 16 and air scavenging channel 20. Fuel is controllably injected into combustion chamber 22 using a fuel injector 24. The non-metallic, carbon—carbon bearing surfaces defined by the outside bearing surface of the piston head and inside surface 38 of combustion cylinder 14 allow the piston to be used within combustion cylinder 22 without the use of piston ring grooves or piston rings.

The portion of the piston head defining the bearing surface is constructed from a material having low friction, low thermal expansion and high temperature resistance properties. The need for lubricating oil and cooling fluid in the free piston engine is thus eliminated, thereby eliminating the increased physical size and decreased efficiency losses associated with such structure. Additionally, the radial clearance between the piston head and cylinder inside surface is substantially reduced or eliminated, thereby eliminating the need for piston ring grooves and piston rings in the piston head.

Other aspects, objects and advantages of this invention can be obtained from a study of the drawings, the disclosure and the appended claims.

What is claimed is:

1. A free piston internal combustion engine, comprising:

a combustion cylinder having an inside surface; and a piston reciprocally disposed within said combustion cylinder, said piston including a piston head and a plunger rod attached to said piston head, said piston head including a cap and a metallic skirt attached to said cap and interconnecting said cap with said plunger rod, said cap and said skirt being connected together in a manner such that said cap is capable of moving a limited extent in a radial direction relative to said skirt, said cap and said skirt having a first cap diameter and a first skirt diameter, respectively, at a non-operating temperature, said first cap diameter being greater than said first skirt diameter, said cap having an outside surface lying closely adjacent to and defining a bearing surface with said inside surface of said combustion cylinder, said cap consisting essentially of a non-metallic material.

2. The free piston internal combustion engine of claim 1, wherein said non-metallic material is selected from the group consisting of composite and ceramic materials.

3. The free piston internal combustion engine of claim 2, wherein said non-metallic material consists essentially of a carbon—carbon composite material having carbon reinforcing fibers within a carbon matrix.

4. The free piston internal combustion engine of claim 3, wherein said carbon reinforcing fibers are oriented in at least one direction within said cap.

5. The free piston internal combustion engine of claim 1, wherein said non-metallic material has a coefficient of thermal expansion of between approximately 0.5 and 10 ppm/° C.

6. The free piston internal combustion engine of claim 5, wherein said non-metallic material has a coefficient of thermal expansion of between approximately 1 and 2 ppm/° C.

7. The free piston internal combustion engine of claim 1, wherein said non-metallic material has a coefficient of friction of between 0.01 and 0.15.

8. The free piston internal combustion engine of claim 7, wherein said non-metallic material has a coefficient of friction of approximately 0.10.

9. The free piston internal combustion engine of claim 1, wherein said non-metallic material has a temperature resistance up to between approximately 400° C. and 2500° C.

10. The free piston internal combustion engine of claim 9, wherein said non-metallic material has a temperature resistance up to approximately 500° C.

11. The free piston internal combustion engine of claim 1, wherein said outside surface of said cap and said inside surface of said combustion cylinder have a radial operating clearance therebetween of approximately between 0.000 and 0.002 inch.

12. The free piston internal combustion engine of claim 11, wherein said outside surface of said cap and said inside surface of said combustion cylinder have a radial operating clearance therebetween of approximately 0.000 inch.

13. The free piston internal combustion engine of claim 1, wherein said combustion cylinder has a liner defining said inside surface, said liner consisting essentially of a non-metallic material.

14. The free piston internal combustion engine of claim 13, wherein said non-metallic material of said liner is selected from the group consisting of composite and ceramic materials.

15. The free piston internal combustion engine of claim 14, wherein said non-metallic material of said liner consists essentially of a carbon-carbon composite material having carbon reinforcing fibers within a carbon matrix.

16. A free piston internal combustion engine, comprising:

a combustion cylinder having an inside surface; and a piston reciprocally disposed within said combustion cylinder, said piston including a piston head and a plunger rod attached to said piston head, said piston head including a cap and a skirt attached to said cap and interconnecting said cap with said plunger rod, said cap and said skirt being connected together in a manner such that said cap is capable of moving a limited extent in a radial direction relative to said skirt, said cap having an outside surface lying closely adjacent to and defining a bearing surface with said inside surface of said combustion cylinder, said bearing surface consisting essentially of a non-metallic material, said skirt having an outside surface, said outside surface of said cap and said outside surface of said skirt together comprising an outside surface of said piston head, said outside surface of said piston head having an absence of a piston ring groove and a piston ring.

17. A free piston internal combustion engine, comprising:

a combustion cylinder having a liner with an inside surface, said liner consisting essentially of a non-metallic material; and a piston reciprocally disposed within said combustion cylinder, said piston including a piston head and a plunger rod attached to said piston head, said piston head including a cap and a skirt attached to said cap and interconnecting said cap with said plunger rod, said cap and said skirt being connected together in a manner such that said cap is capable of moving a limited extent in a radial direction relative to said skirt, said cap and said skirt having a first outside cap diameter and a first outside skirt diameter, respectively, at a non-operating temperature, said first outside cap diameter being greater than said first outside skirt diameter, said cap having a cylindrical outside surface lying closely adjacent to and defining a bearing surface with said inside surface of said combustion cylinder, said cap consisting essentially of a non-metallic material.

18. The free piston internal combustion engine of claim 17, wherein said cap consists essentially of a carbon—carbon composite material having carbon reinforcing fibers within a carbon matrix.

19. The free piston internal combustion engine of claim 18, wherein said liner consists essentially of a carbon—carbon composite material having carbon reinforcing fibers within a carbon matrix.

20. The free piston internal combustion engine of claim 1, said cap including a stepped inner surface and said skirt including a shoulder, said stepped inner surface and said shoulder having a radial clearance therebetween.

21. The free piston internal combustion engine of claim 20, said stepped inner surface having a plurality of radially-extending holes formed therein, said holes extending into said cap, each said hole receiving a respective set screw therein, each said respective set screw being threadedly engaged with said shoulder, each said hole having a respective hole diameter and each said respective screw having a respective screw diameter, each said respective hole diameter exceeding said respective screw diameter.

* * * * *